US010131143B2

(12) United States Patent
Snir et al.

(10) Patent No.: US 10,131,143 B2
(45) Date of Patent: Nov. 20, 2018

(54) PRINTING MACHINES FOR SEAMLESS TEXTILES

(71) Applicant: Kornit Digital Ltd., Rosh HaAyin (IL)

(72) Inventors: Ohad Snir, Kiryat-Ono (IL); Ofer Ben-Zur, Hod-HaSharon (IL)

(73) Assignee: Kornit Digital Ltd., Rosh HaAyin (IL)

( * ) Notice: Subject to any disclaimer, the term of this patent is extended or adjusted under 35 U.S.C. 154(b) by 0 days.

(21) Appl. No.: 15/716,551

(22) Filed: Sep. 27, 2017

(65) Prior Publication Data

US 2018/0086061 A1 Mar. 29, 2018

Related U.S. Application Data

(60) Provisional application No. 62/400,096, filed on Sep. 27, 2016.

(51) Int. Cl.

| | |
|---|---|
| ***B41J 13/22*** | (2006.01) |
| ***B41J 2/14*** | (2006.01) |
| ***B41J 1/54*** | (2006.01) |
| ***B41J 3/407*** | (2006.01) |
| *B41J 25/00* | (2006.01) |

(52) U.S. Cl.

CPC . *B41J 2/14* (2013.01); *B41J 1/54* (2013.01); *B41J 3/4078* (2013.01); *B41J 13/223* (2013.01); *B41J 2025/008* (2013.01)

(58) Field of Classification Search

CPC ..... B41J 1/54; B41J 2/01; B41J 2/14; B41J 3/4078; B41J 13/223; B41J 2025/008

See application file for complete search history.

(56) References Cited

U.S. PATENT DOCUMENTS

| | | | | |
|---|---|---|---|---|
| D254,079 | S | 1/1980 | Berghoff | |
| D273,202 | S | 3/1984 | Oglander et al. | |
| D295,639 | S | 5/1988 | Oglander et al. | |
| D326,111 | S | 5/1992 | Otsuka et al. | |
| 5,267,801 | A | 12/1993 | Huang | |
| D347,021 | S | 5/1994 | Adams et al. | |
| 6,302,982 | B1 * | 10/2001 | Corey | B29C 66/437 156/73.4 |
| 6,389,850 | B1 * | 5/2002 | Fujiwara | D04B 1/24 66/171 |
| D536,730 | S | 2/2007 | Blanchard, Jr. et al. | |
| 7,185,579 | B2 * | 3/2007 | Allart | F03C 1/0444 91/491 |
| D542,344 | S | 5/2007 | Duby et al. | |
| D542,838 | S | 5/2007 | Blanchard, Jr. et al. | |
| 7,739,971 | B2 * | 6/2010 | Chambers | A61F 2/2415 112/475.01 |
| D788,214 | S | 5/2017 | Egami et al. | |
| 2005/0206935 | A1 | 9/2005 | Cox et al. | |

(Continued)

OTHER PUBLICATIONS

Official Action dated Jun. 13, 2018 From the US Patent and Trademark Office Re. U.S. Appl. No. 29/578,980. (10 pages).

(Continued)

*Primary Examiner* — Anh T Vo

(57) ABSTRACT

A printing machine and method for using the same, for printing seamless fabrics provided in tube form, the printing machine comprising a drum on which a tube of the fabric is fitted; and a print head placed in proximity to said drum to print onto the tube fabric as it rotates on the drum. The print head moves axially on the drum to advance the printing.

22 Claims, 8 Drawing Sheets

(56) References Cited

U.S. PATENT DOCUMENTS

| | | | |
|---|---|---|---|
| 2017/0190169 | A1 | 7/2017 | Behnke et al. |
| 2017/0197404 | A1 | 7/2017 | Behnke et al. |

OTHER PUBLICATIONS

Official Action dated Nov. 7, 2017 From the US Patent and Trademark Office Re. U.S. Appl. No. 29/578,980. (12 pages).
Alibaba "2016 Seamless 360 Degree Hosiery Digital Printing Machine Underwear Printing Machine" Retrieved from alibaba.com, 2 Pages, Oct. 24, 2017.
Kwon et al. "Textile Printing Pretreatment Device for the Guide Rollers", Nite Industrial Co Ltd, (KR), 5 Pages, Feb. 4, 2016.
Advisory Action Before the Filing of an Appeal Brief dated Sep. 11, 2018 From the US Patent and Trademark Office Re. U.S. Appl. No. 29/578,980. (7 pages).

* cited by examiner

PRINTING MACHINES FOR SEAMLESS TEXTILES

RELATED APPLICATIONS

This application claims the benefit of priority under 35 USC § 119(e) of U.S. Provisional Patent Application No. 62/400,096 filed on Sep. 27, 2016. The contents of the above application are all incorporated by reference as if fully set forth herein in their entirety.

FIELD AND BACKGROUND OF THE INVENTION

The present invention, in some embodiments thereof, relates to a printing machine for seamless textiles and, more particularly, but not exclusively, to a digital ink jet printing machine for such seamless textiles.

Seamless textiles are textiles ready made into tube shapes so that there is no need to add a seam down the side when making a garment. Instead of connecting two ends together to make a closed side the textile is initially manufactured as a tube. The tubes are particularly in demand for use in women's underwear that is intended for wearing underneath tight clothing. Conventional underwear has seams which can be visible as protruding lines through the tight clothing and such protrusions are considered unsightly. Seamless underwear based on textile tubes is probably the most comfortable of a number of solutions marketed to deal with the problem.

Of course seamless textiles are not restricted to underwear but may be used for other kinds of garments as well. Unfortunately however tube fabrics are difficult to print on a textile printer. It is possible to place the item to be printed, either in tube form or as the finished underwear or clothing, on a tray of the kind used for printing a tee-shirt and such an arrangement can be used to print a picture or a slogan on one side. The item may then be reversed for printing on the other side if desired. However it is not possible to print all around the tube or provide an image or pattern that is continuous around the tube.

SUMMARY OF THE INVENTION

The present embodiments may relate to a printing machine that consists of a rotating drum or cylinder over which the textile tube or finished item is fitted. A printing head is placed in proximity to the drum to print the item as the item rotates.

The printing head typically includes multiple printing nozzles, which may be aligned along the circumference of the drum. The nozzles follow the curvature of the drum so that all the nozzles are substantially at the same distance from the fabric, and the virtual printing image that is used to control the printer may be an image that is wrapped onto a virtual 3D cylinder.

According to an aspect of some embodiments of the present invention there is provided a printing machine for printing seamless fabric in tube form, the printing machine comprising:

a drum on which a tube of the seamless fabric is fittable; and a print head placed in proximity to the drum to print onto the tube, the tube being fitted onto the drum.

In an embodiment, the print head comprises a plurality of print nozzles.

In an embodiment, the print nozzles are aligned along a circumferential direction of the drum.

In an embodiment, the print nozzles are aligned along a curvature of the circumference so that all of the plurality of nozzles are at substantially a same distance from the fabric.

In an embodiment, the drum is removable.

In an embodiment, the drum is interchangeable with other drums of different circumferences, and wherein the print head comprises nozzles, the nozzles being adjustable for curvature of the different circumferences.

In an embodiment, printing is carried out by rotating the drum while the print head moves along an axis of the drum.

In an embodiment, the print head is controlled to print via a virtual printing image that is cylindrical.

In an embodiment, the cylindrical printing image is formed by wrapping an image into the cylinder so that the image is continuous.

According to a second aspect of the present invention there is provided a method of printing a seamless fabric comprising:

fitting the seamless fabric over a drum;

rotating the drum over a plurality of rotations; and carrying out printing using a print head located in proximity to the drum.

An embodiment may comprise advancing the print head along an axis of the drum following ones of the rotations.

The drums may be interchangeable and the user may select from a plurality of drums having different circumferences to find a best fit for a given fabric.

The drum may be interchangeable with other drums of different circumferences, and the print nozzles may be adjusted the nozzles for curvature of the different circumferences.

The print head may be controlled to print via a virtual printing image that is cylindrical, and which may, for example be formed by wrapping an image into the cylinder so that the image is continuous.

According to a third aspect of the present invention there is provided a method of controlling a printer to print on a non-flat surface, comprising:

providing a virtual image defining pixels to be printed;

wrapping the virtual image onto a virtual 3D representation of the non-flat surface; and using the wrapped virtual image to control a print head to print the pixels.

In an embodiment, the non-flat surface comprises a cylinder.

In an embodiment, the virtual image comprises first and second oppositely facing edges that are brought into contact during the wrapping.

In an embodiment, the wrapping further comprises carrying out image processing to remove discontinuities between the first and second sides that are brought into contact.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
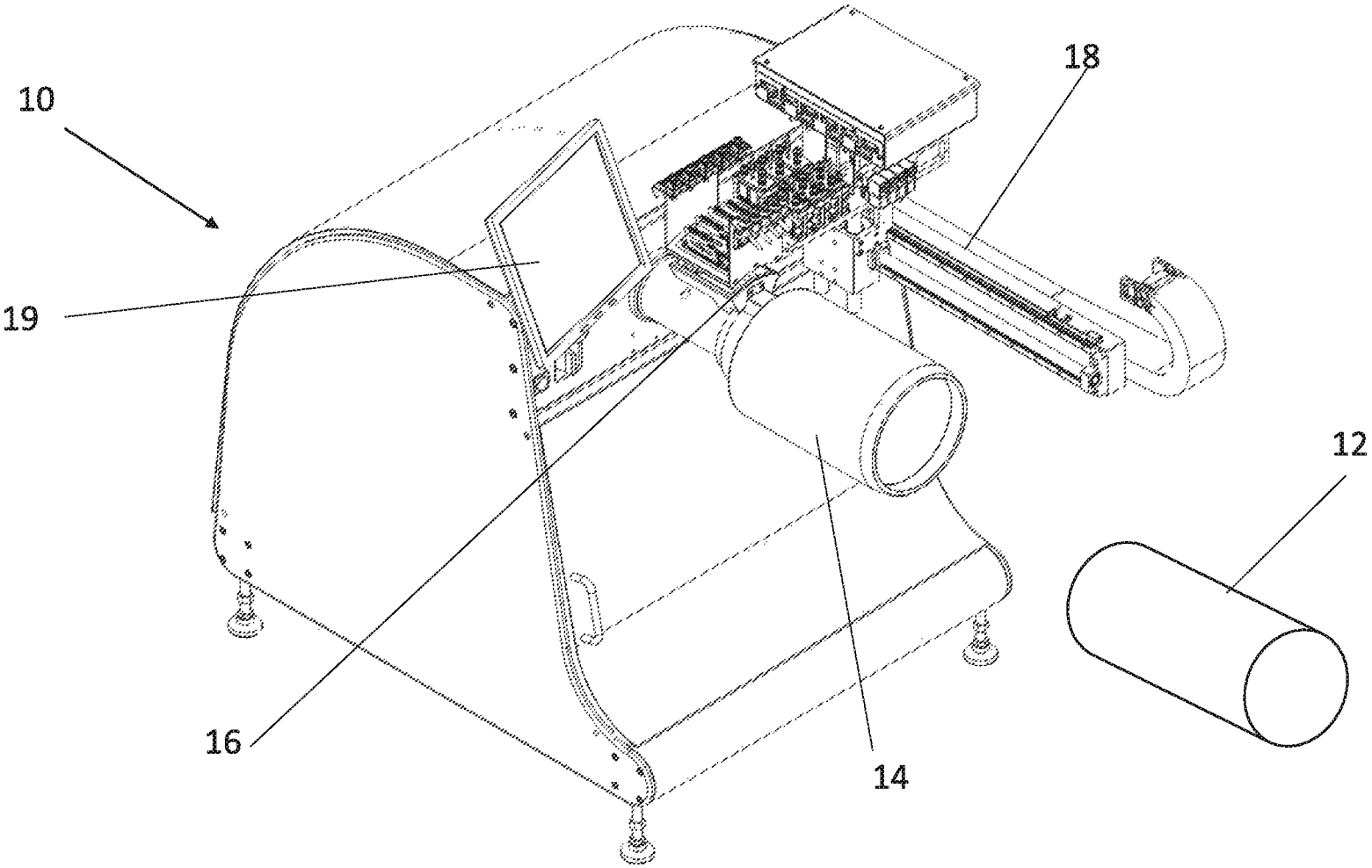
FIG. 1 is a schematic front perspective view from above of a textile printing machine according to embodiments of the present invention.

The present invention, in some embodiments thereof, relates to a printing machine for seamless textiles and, more particularly, but not exclusively, to a digital printing machine such as an ink jet printer.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIGS. 1 to 6 are six different perspective views that illustrate a printing machine 10 for printing of fabrics, in particular, textiles, that are pre woven into tubes so as to make seamless clothing. Referring first to FIG. 1, and reference numeral 12 indicates a tube of fabric. The printing machine includes rotating drum 14, onto which the tube of fabric 12 is fitted. The drum 14 rotates and printhead 16, located in proximity to the drum and the tube, sprays pretreatment fluids and different colored inks onto the fabric. The head 16 is mounted on arm 18 which is aligned with the longitudinal axis of the drum. In the course of printing the head 16 travels in and out along the arm to print circumferential lines around the tube 12 as the tube rotates with the drum. The print head 16 may be placed into relatively close proximity with the fabric, say within 1 to 2 mm, in order to achieve high definition printing.

A touch-screen 19, or a conventional computer screen and keyboard may be used to control operation of the printing machine 10. Alternatively or additionally the machine may be remotely controlled via Bluetooth or infra-red or wire or Wifi, or by other computers connecting via LANs or via the Internet. Likewise, multiple machines may be controlled together.

As mentioned, the print head may internally be made up of multiple print nozzles extending around a segment of the circumference. There may be one nozzle for each of the primary colors used in printing as well as an additional nozzle used for a pretreatment fluid. The print nozzles may be aligned along the circumferential direction of the drum and furthermore may be aligned with the curvature of the drum, that is to say the nozzles align along the curvature of the circumference. The nozzles thus form a segment of a curve, where the curve shares the curvature of the circumference of the drum. Thus even though the nozzles are at different angles to the drum, each of the nozzles may be placed at the same predetermined distance from the surface of the fabric. That predetermined distance may be fixed for the machine or may be set individually for the desired printing definition or fabric type.

Typically, tubes 12 may be of different sizes, in order to provide different sizes of clothing. Thus different sizes of drum are provided to provide good fits for the different sizes of tubes. In general seamless clothing is made of easily stretchable fabrics so that a small number of drums can cater for a wide range of sizes. The drums may thus be removable and exchangeable with drums of other sizes. However, when the drum is changed the printing head may require repositioning, and the printing nozzles may be realigned with the new drum circumference. That is to say the print head and the nozzles are adjustable for the curvatures of the different circumferences.

In one embodiment the print carriage, which carries the print head, is mounted on an axis. The print head may be moved higher or lower to accommodate different sizes of drum and also to accommodate different thicknesses of fabric.

Printing is typically carried out by rotating the drum 14 while the print head travels up and down along the axis of the drum along the support arm 18.

Figure 2:
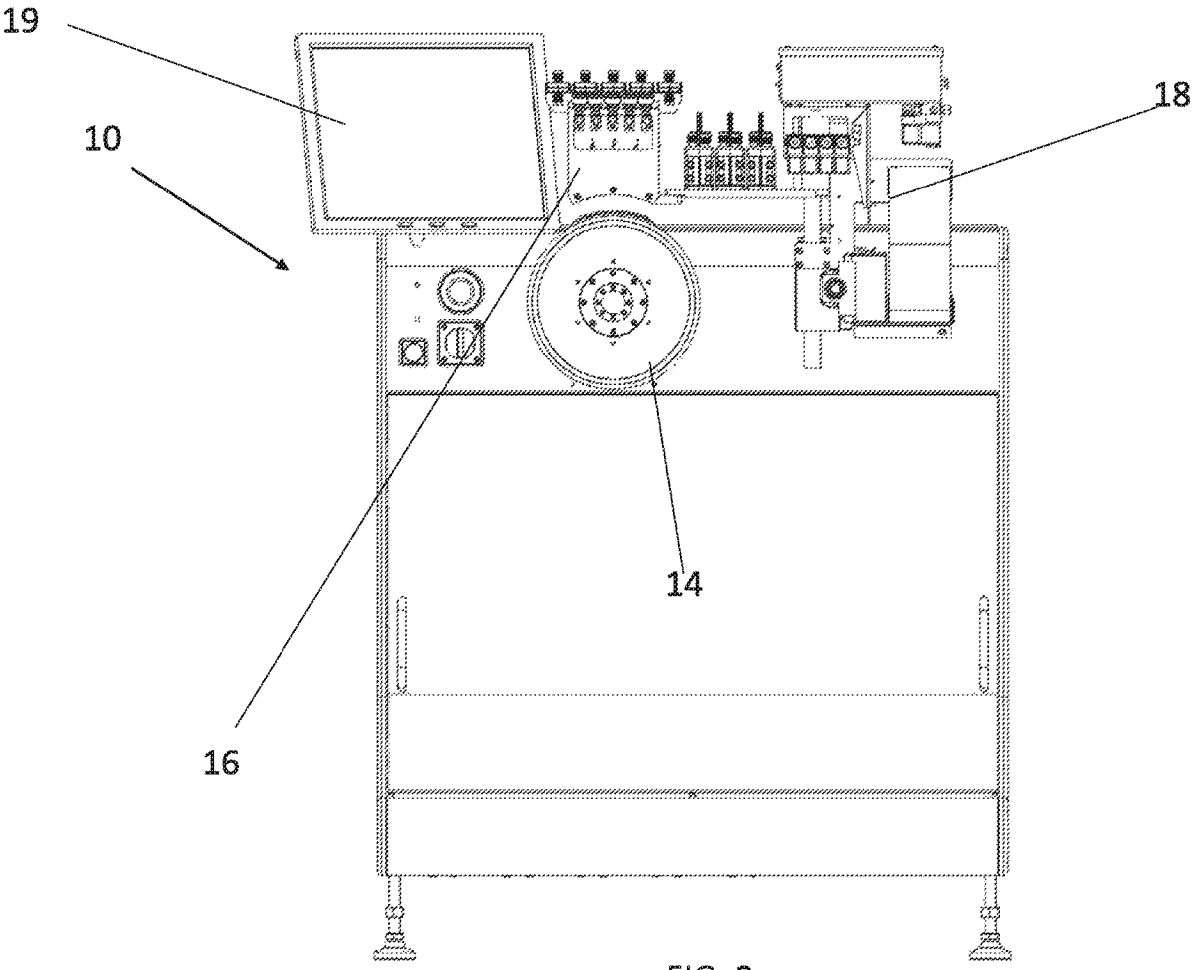
FIG. 2 is a schematic front view of the textile printing machine of FIG. 1.

FIG. 2 is a schematic front view of the textile printing machine of FIG. 1 and particularly showing how the print head 16 is curved to follow the contour of the drum 14. As discussed, the nozzles inside may be adjusted to follow the varying contours of the different sized drums.

Figure 3:
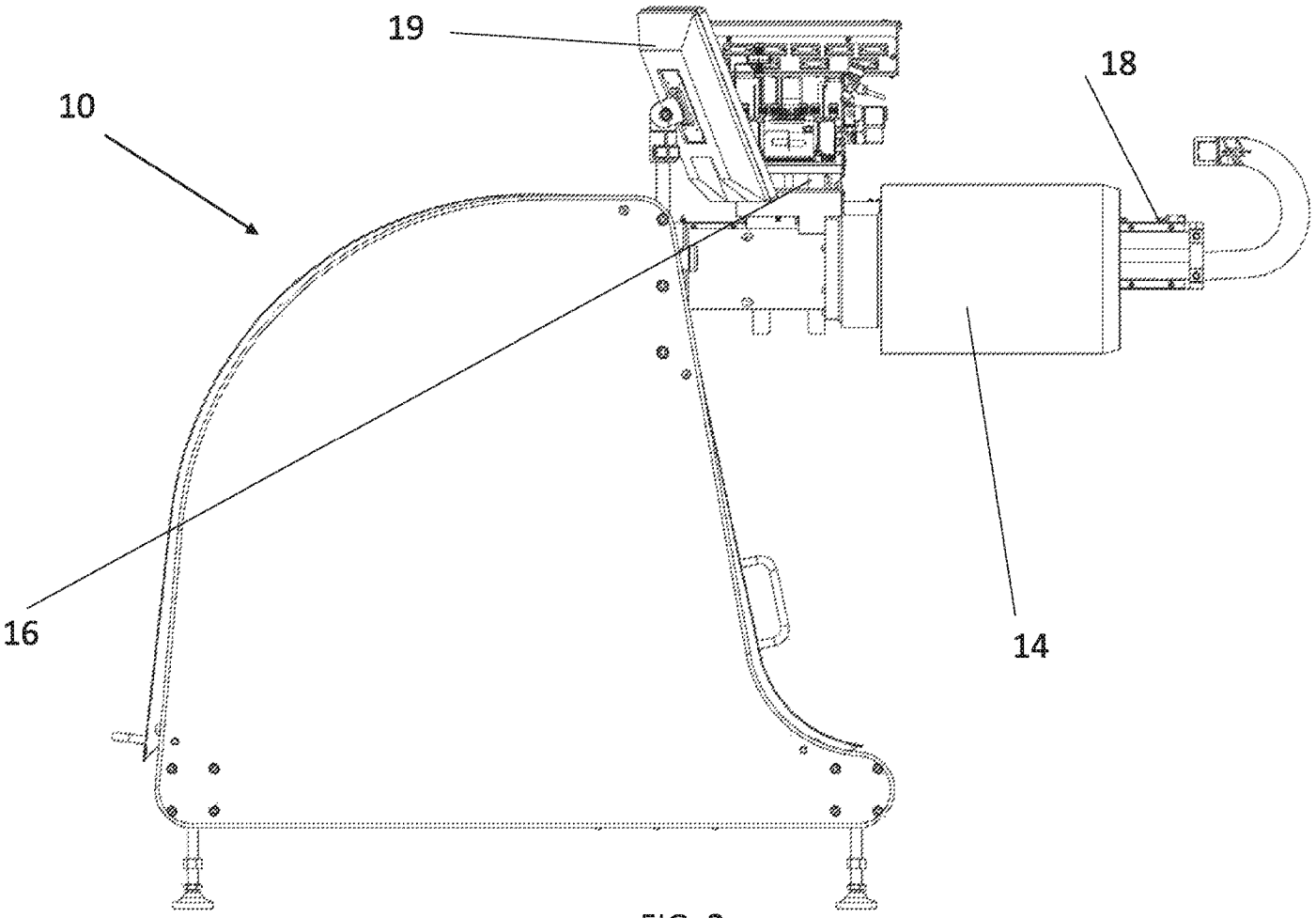
FIG. 3 is a schematic side view from the drum side of the textile printing machine of FIG. 1.

FIG. 3 is a schematic side view from the drum side of the textile printing machine of FIG. 1 and showing the drum 14 extending in the same axial direction as the arm 18 so that as the head 16 rides along the arm, it travels along the length of the drum.

Figure 4:
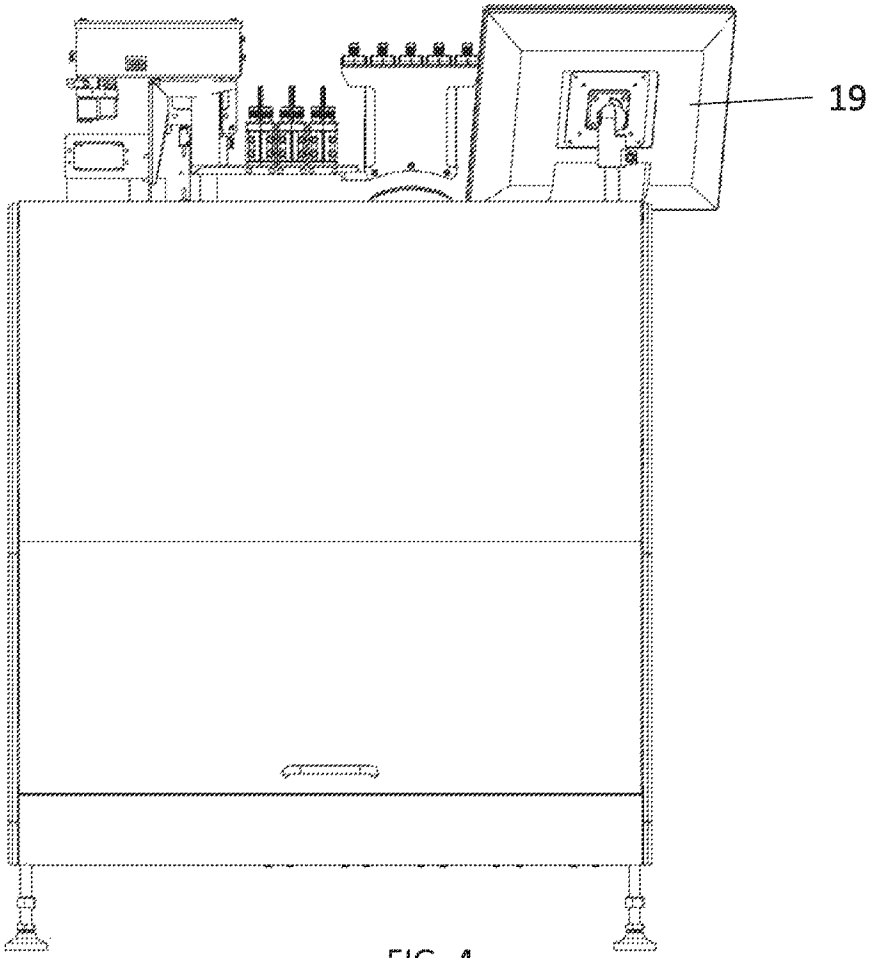
FIG. 4 is a schematic rear view of the textile printing machine of FIG. 1.

FIG. 4 is a schematic rear view of the textile printing machine of FIG. 1.

Figure 5:
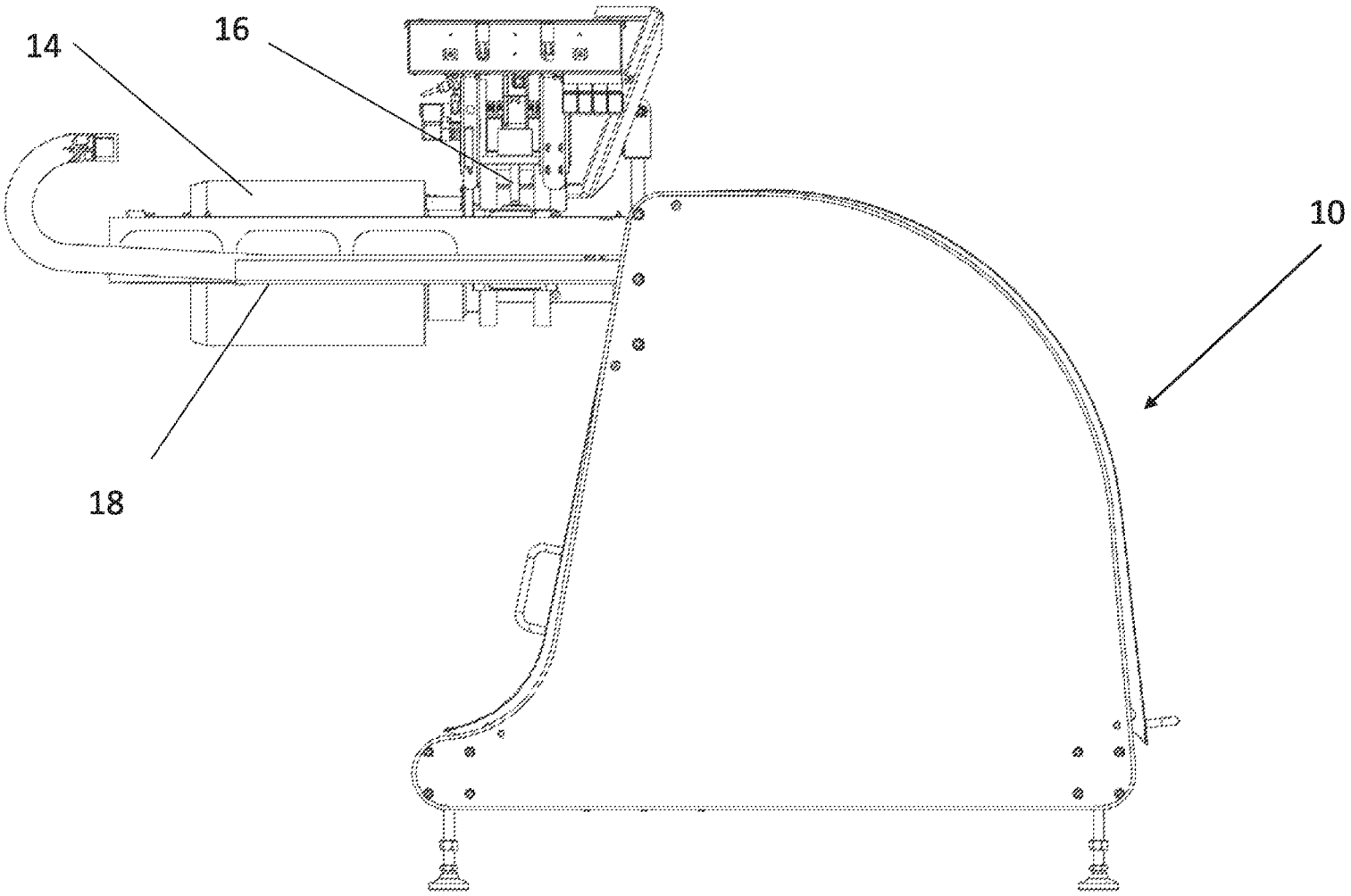
FIG. 5 is a schematic side view from the arm side of the textile printing machine of FIG. 1.

FIG. 5 is a schematic side view from the arm side of the textile printing machine of FIG. 1. In FIG. 5, the print head 16 can be seen to be mounted on the arm 18 in order to travel the length of the arm during the printing operation.

Figure 6:
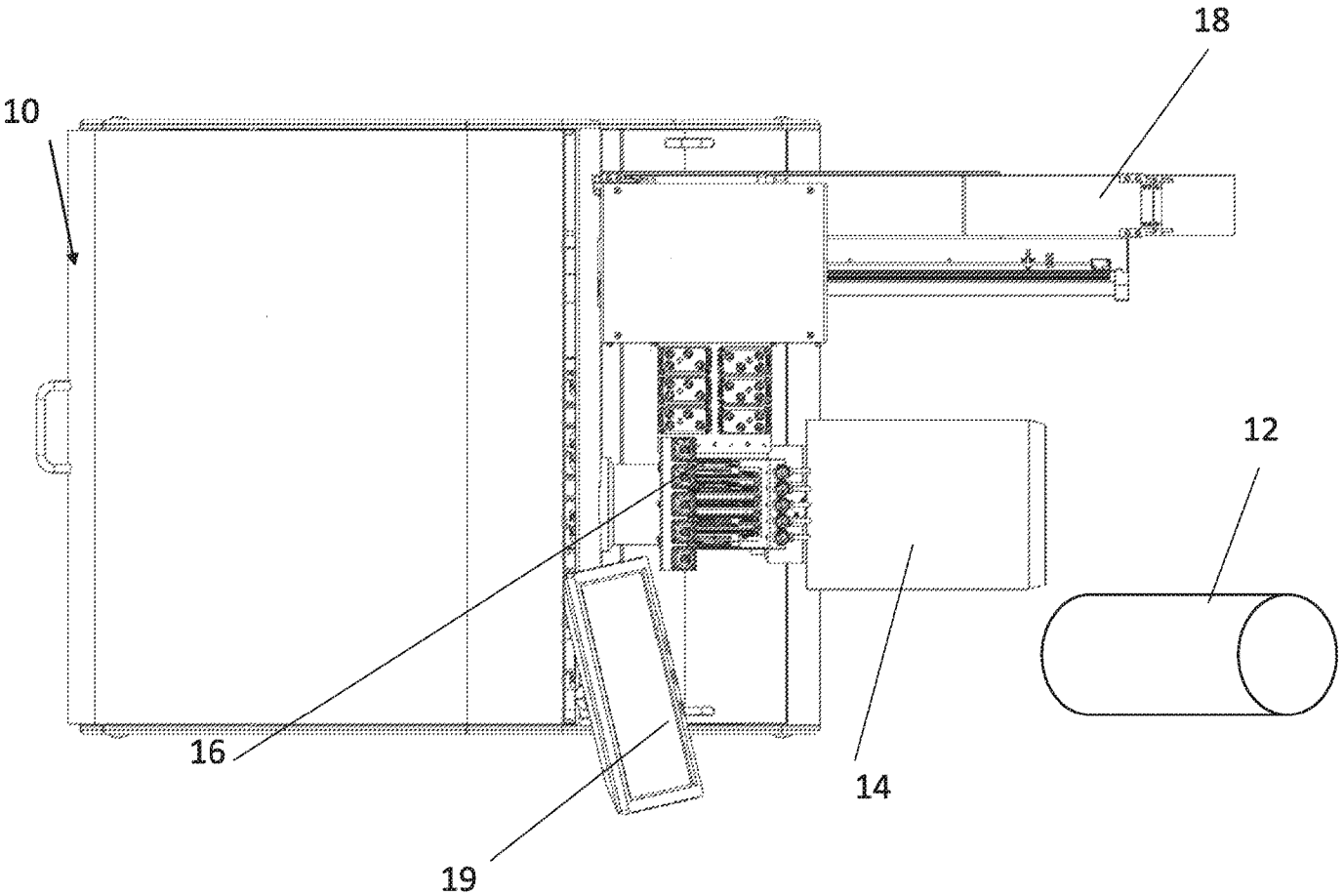
FIG. 6 is a schematic view from above of the textile printing machine of FIG. 1.

FIG. 6 is a schematic view from above of the textile printing machine of FIG. 1, showing the print head 16 in its initial position before it has begun travelling along the axial length of the drum 14.

Figure 7:
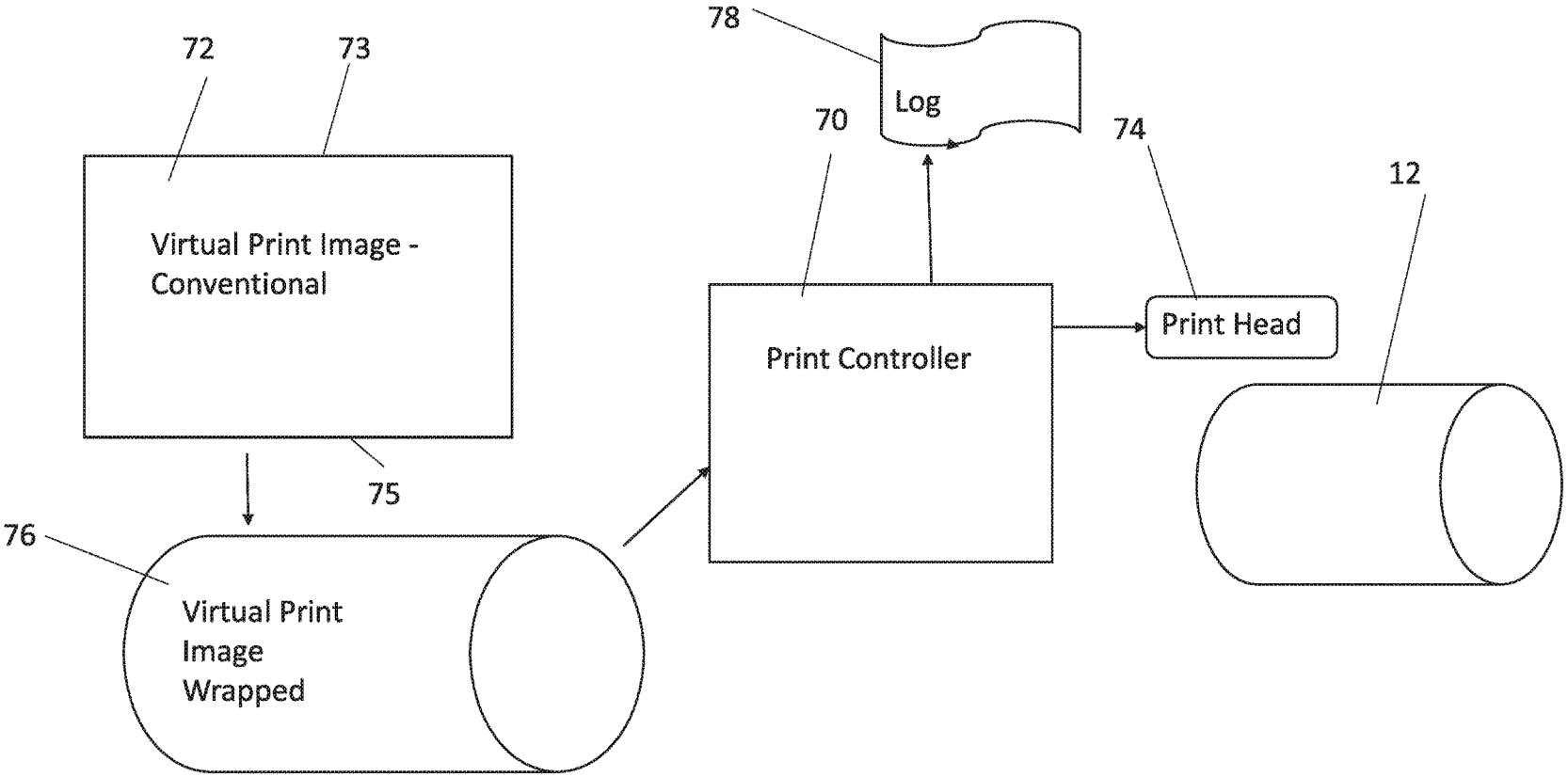
FIG. 7 is a schematic control diagram for the textile printing machine of FIG. 1.

Reference is now made to FIG. 7 which illustrates control of the print head of the present embodiments. Conventionally, a print controller 70 uses a virtual print image 72 to map out the pixels to be printed by print head 74, and the controller reaches each pixel with the print head and consults the virtual image for the color to print at the pixel. However in the case of tube 12, opposite sides of the image are joined and it would be unsightly to have a discontinuity in the printing image where the edges of the virtual print image are crossed.

Thus, in accordance with the present embodiments, the conventional virtual printing image may be projected onto a 3D cylinder shape 76 by wrapping the image so that the opposite edges 73 and 75 are brought together. Optionally, both automatic and manual image processing techniques can be used to ensure that there is no discontinuity in the image, that patterns match up across the boundary etc. That is to say it may be ensured that the image is continuous around the cylinder. Thus the virtual 3D shape may serve as the printing map for print controller 70.

The controller 70 may keep a log 78 of operations, in particular including numbers and times of printing operations as well as diagnostic and failure information.

Figure 8:
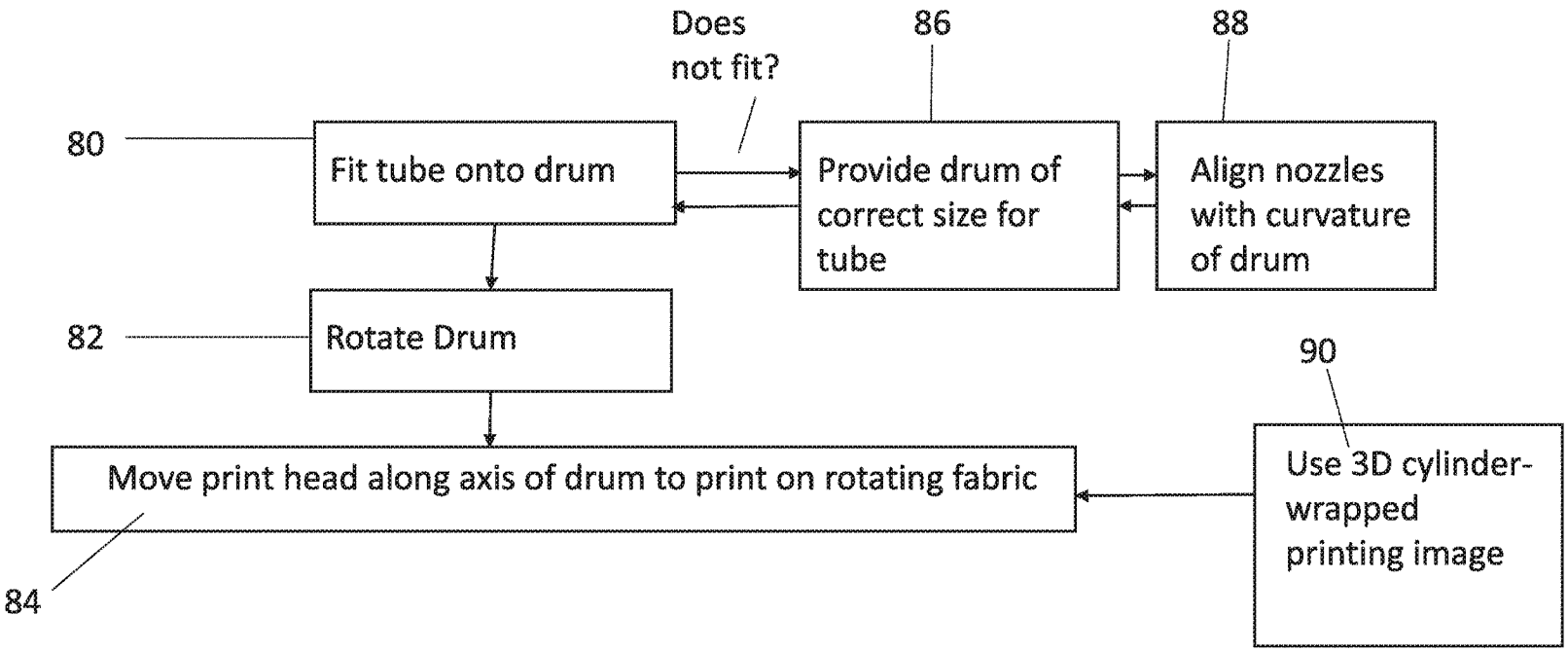
FIG. 8 is a simplified flow chart illustrating operation of the textile printing machine of FIG. 1.

Reference is now made to FIG. 8, which is a simplified diagram illustrating a method of printing a seamless fabric, which method may be used with the printing machine explained in respect of FIGS. 1 to 7. Box 80 indicates fitting the fabric over a drum. In box 82 the drum with the fabric fitted is rotated, and in box 84 the print head moves axially along the drum to print lines along the fabric.

As discussed, the print head is made up of print nozzles, and the nozzles may be aligned along a circumferential direction of the drum so that all of the nozzles are at substantially the same distance from the fabric on the drum.

In general the fabric should be taut for printing, as wrinkles etc. can disrupt the final results. Thus different sized tubes may require different sized drums. This if current drum does not fit it may be exchanged with a drum of a different size, as indicated by box 86. The nozzles may need to be realigned for the curvature of the new drum as indicated by box 88, and the realignment may for example be automatic following machine recognition of the drum or may be manual, by entering the identity of the new drum. In embodiments it may be further possible to manually adjust the nozzle positions, although typically this will be an option restricted to setting up the machine or providing a previously unused drum size not recognized by the software.

Thus the user may select, from a set of drums that are provided, the most suitable fit for a given fabric.

As indicated by box 90, the print head may be controlled to print via a virtual printing image that is cylindrical, and which may be formed by wrapping an image onto the cylinder in such a way that the image is continuous. Referring again to FIG. 7, and the virtual image comprises first and second oppositely facing edges 73 and 75 that are brought into contact during the wrapping operation onto the cylinder to form 3D virtual print image 76. The wrapping operation may optionally include carrying out image processing to remove discontinuities between said first and second sides that are brought into contact.

It is expected that during the life of a patent maturing from this application many relevant printing methods and printers will be developed and the scope of the term printer is intended to include all such new technologies a priori.

As used herein the term "about" refers to ±10%

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A printing machine for printing seamless fabric in tube form, the printing machine comprising:

a drum on which a tube of said seamless fabric is fittable; and a print head placed in proximity to said drum to print onto said tube, said tube being fitted onto said drum.

2. The printing machine of claim 1, wherein said print head comprises a plurality of print nozzles.

3. The printing machine of claim 2, wherein said print nozzles are aligned along a circumferential direction of said drum.

4. The printing machine of claim 3, wherein said print nozzles are aligned along a curvature of said circumference so that all of said plurality of nozzles are at substantially a same distance from said fabric.

5. The printing machine of claim 1, wherein said drum is removable.

6. The printing machine of claim 5, wherein said drum is interchangeable with other drums of different circumferences, and wherein said print head comprises nozzles, said nozzles being adjustable for curvature of said different circumferences.

7. The printing machine of claim 1, wherein printing is carried out by rotating said drum while said print head moves along an axis of said drum.

8. The printing machine of claim 1 wherein said print head is controlled to print via a virtual printing image that is cylindrical.

9. The printing machine of claim 8, wherein said cylindrical printing image is formed by wrapping an image into said cylinder so that the image is continuous.

10. A method of printing a seamless fabric comprising:

fitting said seamless fabric over a drum;

rotating said drum over a plurality of rotations; and carrying out printing using a print head located in proximity to said drum.

11. The method of claim 10, further comprising advancing the print head along an axis of said drum following ones of said rotations.

12. The method of claim 10, wherein said print head comprises a plurality of print nozzles.

13. The method of claim 12, comprising aligning said print nozzles along a circumferential direction of said drum.

14. The method of claim 13, comprising aligning said print nozzles along a curvature of said circumference so that all of said plurality of nozzles are at substantially a same distance from said fabric.

15. The method of claim 10, comprising selecting from a plurality of drums having different circumferences to find a best fit for a given fabric.

16. The method of claim 15, wherein said drum is interchangeable with other drums of different circumferences, and wherein said print head comprises nozzles, the method comprising adjusting said nozzles for curvature of said different circumferences.

17. The method of claim 10, wherein said print head is controlled to print via a virtual printing image that is cylindrical.

18. The method of claim 17, comprising forming said cylindrical printing image by wrapping an image into said cylinder so that the image is continuous.

19. A method of controlling a printer to print on a non-flat surface, comprising:

providing a virtual image defining pixels to be printed;

wrapping said virtual image onto a virtual 3D representation of said non-flat surface; and using said wrapped virtual image to control a print head to print said pixels.

20. The method of claim 19, wherein said non-flat surface comprises a cylinder.

21. The method of claim 19, wherein said virtual image comprises first and second oppositely facing edges that are brought into contact during said wrapping.

22. The method of claim 21, wherein said wrapping further comprises carrying out image processing to remove discontinuities between said first and second sides that are brought into contact.

* * * * *